US007238433B2

(12) United States Patent
Nakamura et al.

(10) Patent No.: US 7,238,433 B2
(45) Date of Patent: Jul. 3, 2007

(54) PLATED AUTOMOTIVE PART AND METHOD

(75) Inventors: Shigetsugu Nakamura, Shiga (JP); Yoshihiko Kawai, Shiga (JP); Ichiro Horide, Shiga (JP)

(73) Assignee: Takata Corporation, Tokyo (JP)

( * ) Notice: Subject to any disclaimer, the term of this patent is extended or adjusted under 35 U.S.C. 154(b) by 0 days.

(21) Appl. No.: 11/086,355

(22) Filed: Mar. 23, 2005

(65) Prior Publication Data

US 2005/0214542 A1 Sep. 29, 2005

Related U.S. Application Data

(60) Provisional application No. 60/555,961, filed on Mar. 25, 2004.

(51) Int. Cl.

| | |
|---|---|
| ***B32B 15/01*** | (2006.01) |
| ***B32B 15/04*** | (2006.01) |
| ***A44B 11/25*** | (2006.01) |
| ***A44B 19/00*** | (2006.01) |

(52) U.S. Cl. ..... 428/680; 428/646; 428/220; 428/332; 280/801.1; 297/464; 24/307; 24/316

(58) Field of Classification Search ..... 428/681, 428/680, 684, 646, 648, 687, 213, 220, 334, 428/335, 336, 332; 280/801.1; 297/464, 297/468; 24/31 R, 33 B, 307, 316, 163 R, 24/174

See application file for complete search history.

(56) References Cited

FOREIGN PATENT DOCUMENTS

JP 06-173072 * 6/1994

* cited by examiner

*Primary Examiner*—Michael E. Lavilla
(74) *Attorney, Agent, or Firm*—Foley & Lardner, LLP

(57) ABSTRACT

A plated automotive part and method of plating are provided. One or more semi-bright finish layers of nickel are plated onto an automotive part. One or more bright finish layers of nickel are plated onto the outermost, semi-bright finish layer of nickel. One or more layers of an alloy are plated onto the outermost, bright-finish layer of nickel. The alloy has a Vickers hardness of 400 VHN or greater.

20 Claims, 7 Drawing Sheets

PLATED AUTOMOTIVE PART AND METHOD

CROSS-REFERENCE TO RELATED APPLICATIONS

This application claims priority to and the benefit of U.S. Provisional Patent Application No. 60/555,961, filed Mar. 25, 2004. The aforementioned provisional application is incorporated by reference herein in its entirety.

BACKGROUND

The present invention relates to plated automotive parts and to methods of plating automotive parts.

As shown in FIG. 1, some automotive parts 10 are conventionally formed of a base metal 12 (e.g., steel) to which one or more layers of nickel (i.e., "Ni") 14 is/are applied. An outer layer 16 of hexavalent chrome has conventionally been applied to the layers 14 of Ni to complete the plating of the base metal 12.

FIG. 2*a* details a conventional method of plating parts of the type shown in FIG. 1 with hexavalent chrome. Specifically, in step S101, a base metal 12 is subjected to a pre-degreasing process. In step S102, the base metal 12 is degreased. In step S103, the degreased base metal 12 is subjected to water washing (one or more times). In step S104, the washed base metal 12 is subjected to acid cleaning (i.e., pickling). In step S105, the base metal 12 is again subjected to water washing (one or more times). In step S106, a semi-bright finish layer 14A of Ni is plated onto the base metal 12. The once-plated base metal 12 is then allowed to cool (i.e., recover) in step S107. In step S108, a bright finish layer 14B of Ni is plated onto the semi-bright layer 14A of Ni. In step S109, the twice-plated base metal 12 is again allowed to recover. In step S110, chromium activation occurs. In step S111, an outer layer 16 of hexavalent chromium is plated onto the bright finish layer 14B of Ni. In step S112, the plated base metal 12 is again allowed to recover. In step S113, the plated base metal 12 is subjected to water washing (one or more times). Finally, in step S114, the plated base metal 12 is subjected to hot water washing.

The chrome plating gives the automotive part an attractive appearance and protects the part from scratches and rust because chromium metal has a high surface hardness and excellent wear resistance and corrosion resistance. Hexavalent chromium, however, is a specified toxic substance, and its use requires treatment of wastewater and exhaust air. Thus, manufacturers using hexavalent chromium must invest in, operate, and maintain a detoxification system and must pay additional costs to meet local regulatory requirements.

FIG. 2*b* details a conventional method of detoxifying wastewater and exhaust air generated during the process shown in FIG. 2*a*. Specifically, in step S201 (which occurs during and/or after steps S101 to S105 in FIG. 2*a*), wastewater is treated to remove or neutralize alkali and acid. In step S202 (which occurs during and/or after steps S106 to S109 in FIG. 2*a*), wastewater is treated to remove or neutralize Ni. In step S203 (which occurs during step S111 of FIG. 2*a*), exhaust air is treated to remove hexavalent chromium by capturing hexavalent chromium mist released into the atmosphere during chromium plating and depositing the captured hexavalent chromium mist in the wastewater. In step S204 (which occurs during and/or after steps S110 to S114 in FIG. 2*a*), wastewater is treated by a reduction treatment of hexavalent chromium to trivalent chromium. Finally, in step S205 (which occurs after step S204), other chromium is treated.

Even when the detoxification treatment is strictly managed, the use of hexavalent chromium presents environmental and safety risks. Such risks include leakage of hexavalent chromium from the manufacturing process potentially resulting in air, soil, and/or water contamination and adherence of hexavalent chromium to products potentially creating adverse health effects in persons exposed to the hexavalent chromium.

Additionally, manufacturers desiring to use hexavalent chromium must satisfy local regulatory requirements and obtain approval and licensing to use hexavalent chromium. Obtaining approval and licensing can be a lengthy process and, in some cases, approval may be impossible to obtain. Even if approval is obtained, risks to the manufacturer include production stoppages due to releases of hexavalent chromium, compensation paid to parties injured by hexavalent chromium contamination, and the cost of environmental cleanup due to hexavalent chromium pollution.

Thus, although chrome has proven to be an effective plating material, its use raises environmental concerns. What is needed, therefore, is an automotive plating and method of plating which, like chrome, provides effective plating properties but which is more environmentally friendly than chrome.

SUMMARY

According an exemplary embodiment of the invention, a plated automotive part and method of plating are be provided. One or more semi-bright finish layers of nickel may be plated onto an automotive part. One or more bright finish layers of nickel may be plated onto the outermost, semi-bright finish layer of nickel. One or more layers of an alloy may be plated onto the outermost, bright-finish layer of nickel. According to a preferred embodiment, the alloy has a Vickers hardness of 400 VHN or greater.

It is to be understood that both the foregoing general description and the following detailed description are exemplary and explanatory only, and are not restrictive of the invention as claimed.

BRIEF DESCRIPTION OF THE DRAWINGS

These and other features, aspects, and advantages of the present invention will become apparent from the following description, appended claims, and the accompanying exemplary embodiments shown in the drawings, which are briefly described below.

DETAILED DESCRIPTION

Embodiments of the present invention will be described below with reference to FIGS. 3–5.

Figure 1:
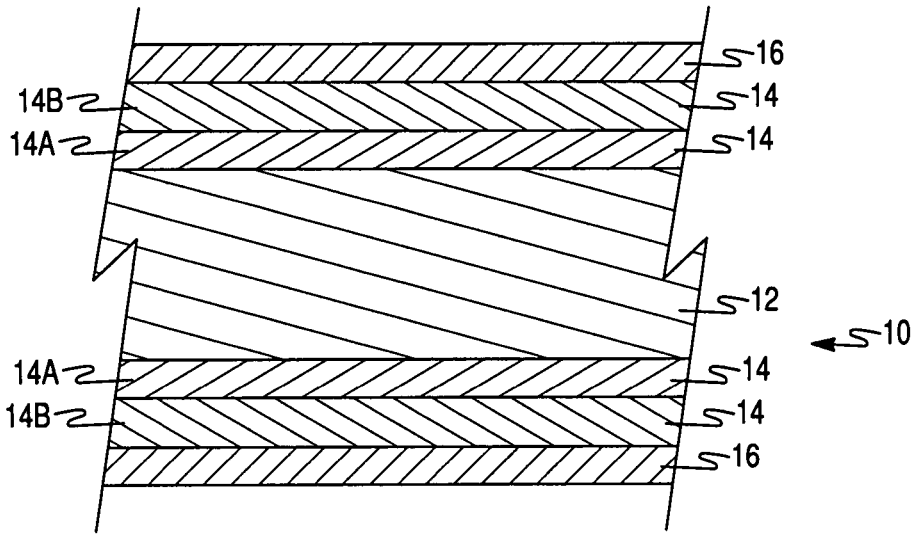
Fig. 1 Prior Art
FIG. 1 is a cross-sectional view of an automotive part covered with a conventional plating material.
Figure 3:
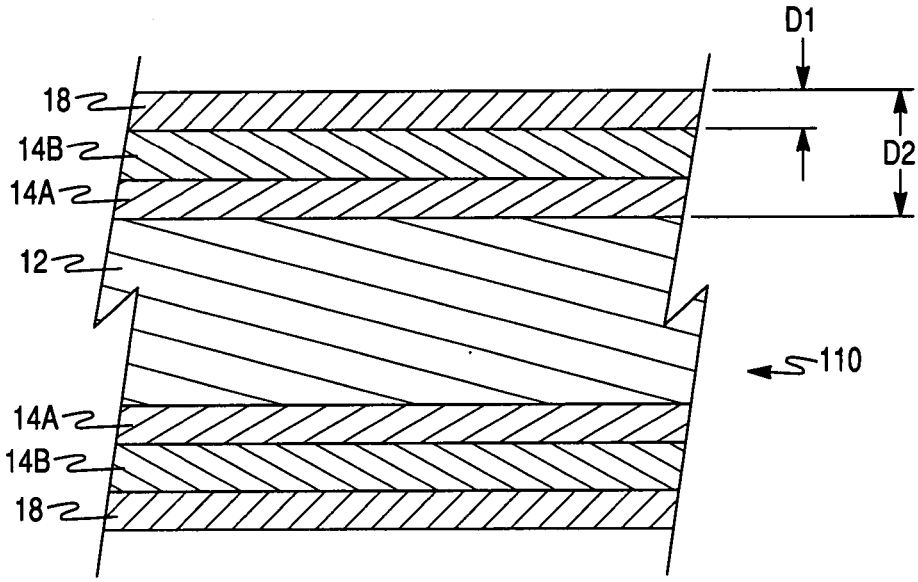
FIG. 3 is a cross-sectional view of an automotive part covered with a plating material according to an embodiment of the present invention.

As shown in FIG. 3, an automotive part 110 includes a base metal 12 (e.g., steel) onto which one or more layers 14 of Ni are applied. Moreover, although only two under layers 14 of Ni are shown, the scope of the present invention includes plated parts and methods of plating involving any number of layers 14 of Ni.

Regardless of the number of layers 14 of Ni, the outermost layer 14 of Ni is coated with a final layer 18, which is an alloy plating. The alloy plating is preferably an Si/Ni alloy and preferably has a Vickers hardness of 400 VHN or greater. The thickness D1 of the outer layer 18 is preferably less than or equal to about 20 μm. Similarly, the thickness D2 of the combined layers 14, 18 is preferably less than or equal to about 100 μm. In addition, although only one outer layer 18 is contemplated in a normal application of the invention, more than one layer may be appropriate for some applications and are, therefore, fully within the scope of the invention.

Figure 4A:
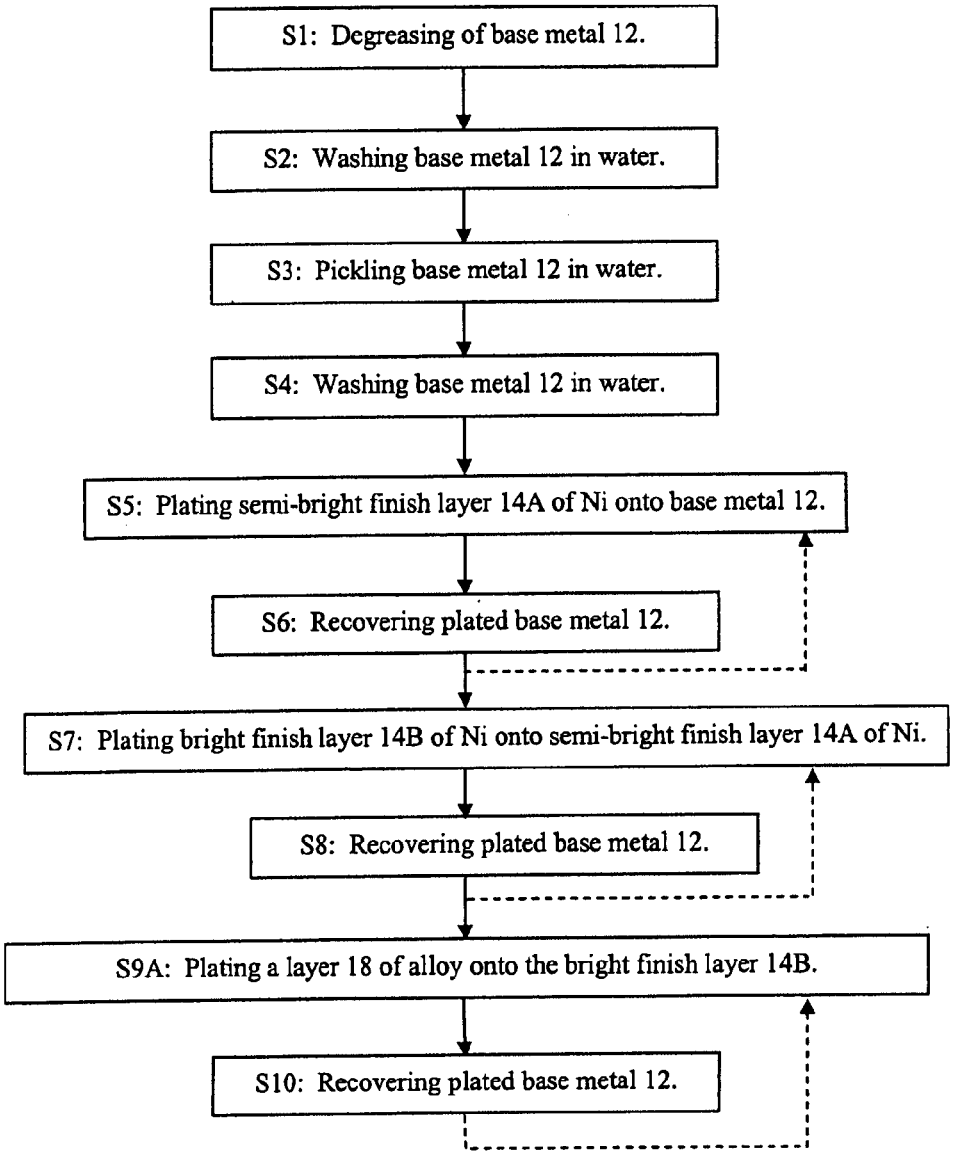
FIG. 4*a* is a block diagram of a plating method according to an embodiment of the present invention.

FIG. 4*a* discloses a method of plating automotive parts of the type shown in FIG. 3 according to an embodiment of the present invention. Specifically, in step S1, a base metal 12 is degreased. In step S2, the degreased base metal 12 is subjected to water washing. In step S3, the washed base metal 12 is subjected to acid pickling. In step S4, the pickled base metal 12 is again subjected to water washing. In step S5, a semi-bright finish layer 14A of Ni is plated onto the base metal 12. The once-plated base metal 12 is then allowed to recover in step S6. In step S7, a bright finish layer 14B of Ni is plated onto the semi-bright layer 14A of Ni. In step S8, the twice-plated base metal 12 is again allowed to recover.

It should be recognized, as indicated by dashed lines in FIG. 4*a*, in some embodiments of the method, after step S6, the method may return to step S5. In these method embodiments, one or more additional layers 14A of semi-bright finish Ni may be added to the first layer 14A of semi-bright finish Ni originally applied in step S5 by successively repeating steps S5 and S6. Upon adding a satisfactory number of semi-bright finish layers 14A of Ni, these method embodiments continue at step S7.

Similarly, as indicated by dashed lines in FIG. 4*a*, in some embodiments of the method, after step S8, the method may return to step S7. In these method embodiments, one or more additional layers 14B of bright finish Ni may be added to the first layer 14B of bright finish Ni originally applied in step S7 by successively repeating steps S7 and S8. Upon adding a satisfactory number of bright finish layers 14B of Ni, these method embodiments continue at step S9A.

Finally, as indicated by dashed lines in FIG. 4*a*, in some embodiments of the method, after step S10, the method may return to step S9A. In these method embodiments, one or more additional layers 18 of the alloy may be added to the first layer 18 of alloy originally applied in step S9A by successively repeating steps S9A and S10. Upon adding a satisfactory number of alloy layers 18, these method embodiments are stopped after a completion of step S10.

Figure 4B:
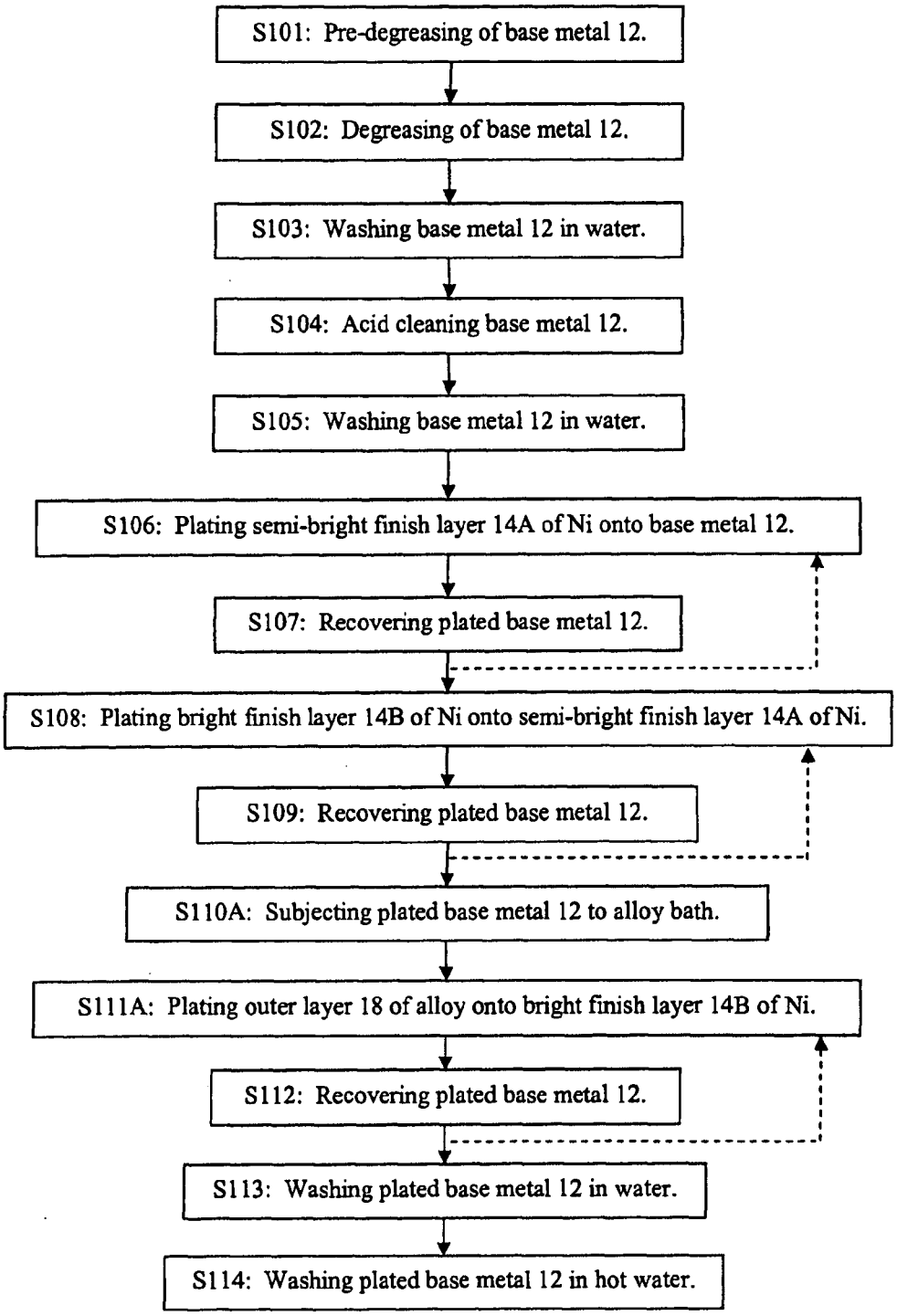
FIG. 4*b* is a block diagram of a plating method according to an embodiment of the present invention.

FIG. 4*b* details a method of plating automotive parts of the type shown in FIG. 3 according to another embodiment of the present invention. Specifically, in step S101, a base metal 12 is subjected to a pre-degreasing process. In step S102, the base metal 12 is degreased. In step S103, the degreased base metal 12 is subjected to water washing (one or more times). The base metal 12 is preferably water washed two times. In step S104, the washed base metal 12 is subjected to acid cleaning (i.e., pickling). In step S105, the base metal 12 is again subjected to water washing (one or more times). The base metal 12 is preferably subjected to water washing two times. In step S106, a semi-bright finish layer 14A of Ni is plated onto the base metal 12. The once-plated base metal 12 is then allowed to cool (i.e., recover) in step S107. In step S108, a bright finish layer 14B of Ni is plated onto the semi-bright layer 14A of Ni. In step S109, the twice-plated base metal 12 is again allowed to recover.

Figure 2A:
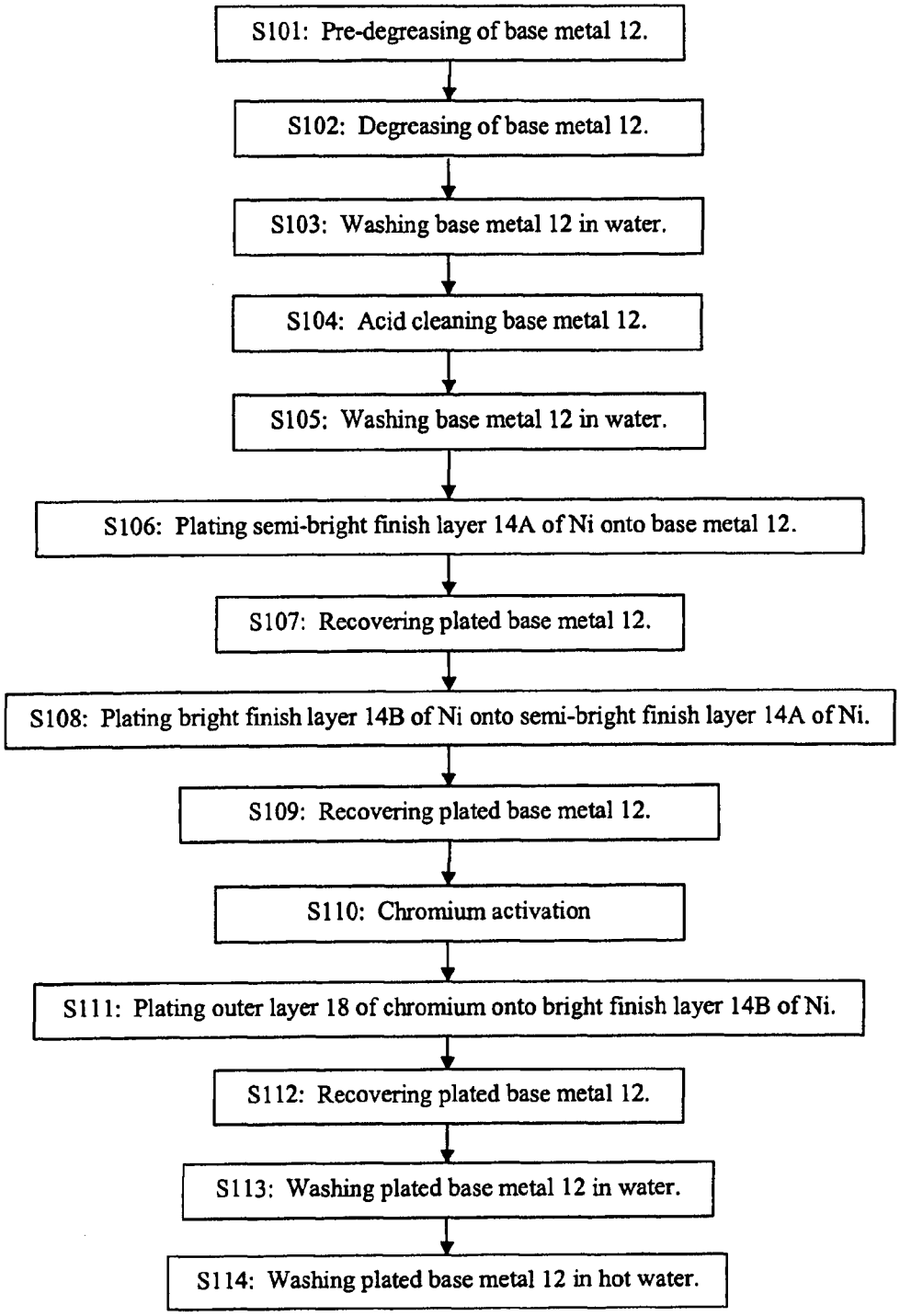
Figure 2a PRIOR ART
FIG. 2*a* is a block diagram of a conventional plating method.

Each of the above-described steps is similar to corresponding steps of the conventional method shown in FIG. 2*a*. However, whereas step S110 of the conventional method involves chromium activation, step S110A of the present invention involves subjecting the base metal 12 to an alloy bath. The alloy bath is preferably an Sn/Ni alloy bath. Additionally, whereas the step S111 of the conventional method involves plating an outer layer 16 of hexavalent chromium onto the bright finish layer 14B of Ni, step S111A of the present invention involves plating an outer layer 18 of alloy onto the bright finish layer 14B of Ni. The alloy is preferably an Si/Ni alloy.

In step S112, the plated base metal 12 is again allowed to recover. In step S113, the plated base metal 12 is subjected to water washing (one or more times). The plated base metal 12 is preferably subjected to water washing two times. Finally, in step S114, the plated base metal 12 is subjected to hot water washing.

It should be recognized, as indicated by dashed lines in FIG. 4*b*, in some embodiments of the method, after step S107, the method may return to step S106. In these method embodiments, one or more additional layers 14A of semi-bright finish Ni may be added to the first layer 14A of semi-bright finish Ni originally applied in step S106 by successively repeating steps S106 and S107. Upon adding a satisfactory number of semi-bright finish layers 14A of Ni, these method embodiments continue at step S108.

Similarly, as indicated by dashed lines in FIG. 4*b*, in some embodiments of the method, after step S109, the method may return to step S108. In these method embodiments, one or more additional layers 14B of bright finish Ni may be added to the first layer 14B of bright finish Ni originally applied in step S108 by successively repeating steps S108 and S109. Upon adding a satisfactory number of bright finish layers 14B of Ni, these method embodiments continue at step S110A.

Finally, as indicated by dashed lines in FIG. 4*b*, in some embodiments of the method, after step S112, the method may return to step S111A. In these method embodiments, one or more additional layers 18 of the alloy may be added to the first layer 18 of alloy originally applied in step S111A by successively repeating steps S111A and S112. Upon adding a satisfactory number of alloy layers 18, these method embodiments continue at step S113.

Figure 4C:
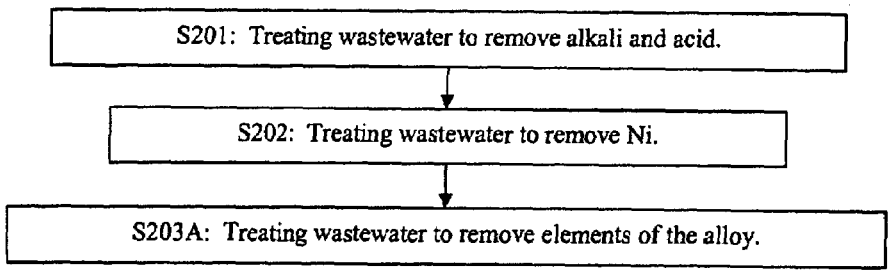
FIG. 4*c* is a block diagram of a wastewater treatment method according to an embodiment of the present invention.

FIG. 4*c* details a method of treating wastewater according to an embodiment of the present invention. Specifically, in step S201 (which preferably occurs during and/or after steps S101 to S105 in FIG. 4*b*), wastewater is treated to remove or neutralize alkali and acid. In step S202 (which occurs during and/or after steps S106 to S109 in FIG. 4*b*), wastewater is treated to remove or neutralize Ni.

Figure 2B:
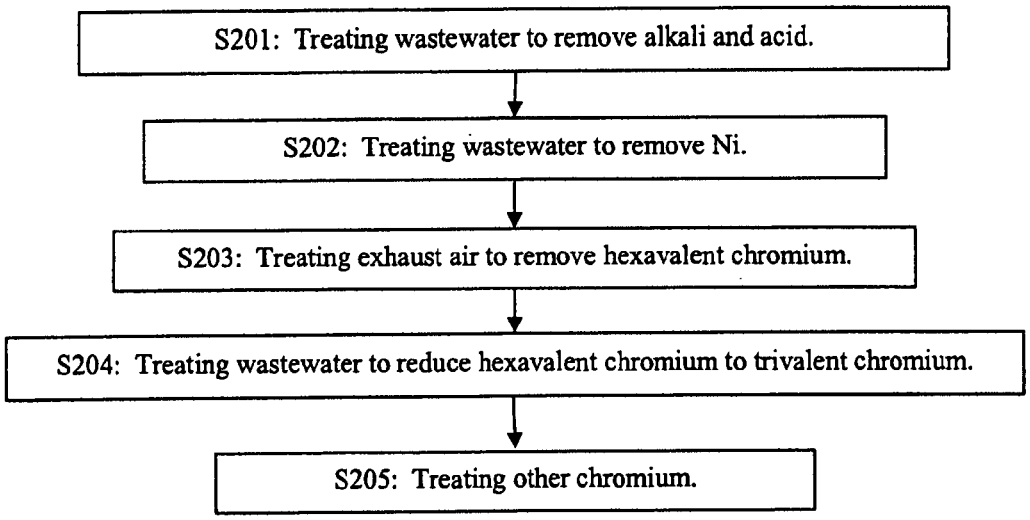
Figure 2b PRIOR ART
FIG. 2*b* is a block diagram of a conventional wastewater and exhaust air treatment method.

Each of the above-described steps is similar to corresponding steps of the conventional method shown in FIG. 2*b*. However, the present invention eliminates step S203 of the conventional method, which involves capturing hexavalent chromium mist released into the atmosphere during chromium plating; eliminates step S204 of the conventional method, which involves wastewater reduction treatment of hexavalent chromium to trivalent chromium and treatment of other chromium; and eliminates step S205, which treats other chromium. In step S203A of the present invention, wastewater is treated to remove or neutralize components of the alloy. For example, when an Sn/Ni allow is used, wastewater is treated to remove or neutralize Sn and Ni.

In an automotive part plated according to the method embodiments described above, the alloy plating may have a lower hardness and poorer wear resistance than conventional chromium plating. Thus, according to an embodiment of the present invention, the plated part may be protected from wear by minimizing the friction against the surface of the plated part. To protect the plated part (e.g., a seatbelt tongue), components in frictional contact with the plated part (e.g., a base and a latch of a seatbelt buckle) may include a coating containing molybdenum disulfide or fluorocarbon resin powder or may be treated with manganese phosphate plating or zinc plating having lower hardness than that of the alloy plating.

Figure 5:
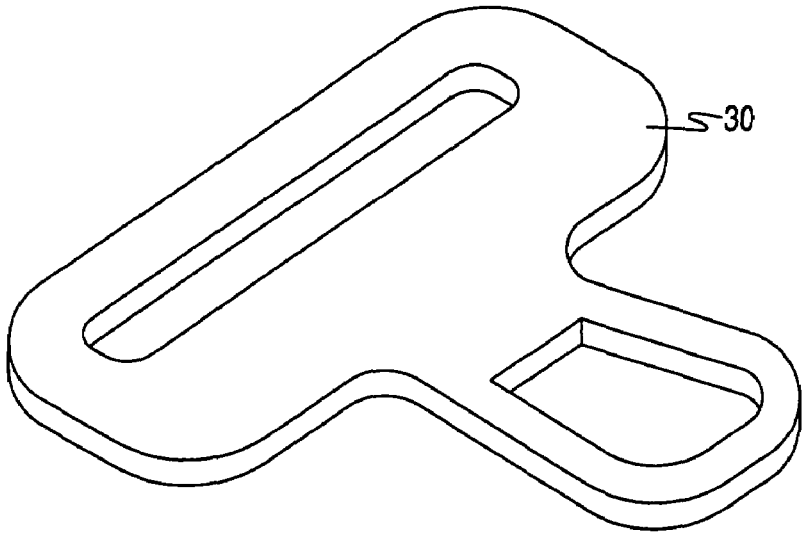
FIG. 5 is a perspective view of an embodiment of a plated automotive part according to the present invention.

FIG. 5 shows an automotive part 30 plated pursuant to the method described in FIG. 4*a* or FIG. 4*b*. The automotive part 30 may be, for example, a seatbelt tongue. However, the present invention is not limited to such tongues. Rather, the invention applies to any automotive part including, but not limited to, a seat belt buckle, a D-ring, a ball (which is part of a vehicle sensor mounted in a seat belt retractor), and other related automotive parts.

Thus, according to embodiments of the present invention, the use of a specified toxic substance in the plating of automotive parts is eliminated so that environmental protection and human safety is improved, wastewater and exhaust air treatment is improved, and manufacturing cost is reduced.

Given the disclosure of the present invention, one versed in the art would appreciate that there may be other embodiments and modifications within the scope and spirit of the invention. Accordingly, all modifications attainable by one versed in the art from the present disclosure within the scope and spirit of the present invention are to be included as further embodiments of the present invention. The scope of the present invention is to be defined as set forth in the following claims.

What is claimed is:

1. A plated automotive part comprising:
a base metal;
a Ni layer on the base metal; and
an outermost plating layer including an alloy,
wherein the outermost plating layer has a Vickers hardness of 400 VHN or greater, and
wherein the alloy comprises Sn/Ni.

2. The part of claim 1, wherein the Ni layer includes a semi-bright finish layer directly on the base metal.

3. The plated automotive part of claim 1, wherein a thickness of the alloy layer is less than about 20 μm.

4. A plated automotive part comprising:
a base metal;
a Ni layer on the base metal; and
an outermost plating layer including an alloy,
wherein the outermost plating layer has a Vickers hardness of 400 VHN or greater,
wherein the Ni layer includes a semi-bright finish layer directly on the base metal, and
wherein the Ni layer includes a bright finish layer overlying the semi-bright finish layer.

5. The plated automotive part of claim 4, wherein a combined thickness of the layers is less than about 100 μm.

6. A system of automotive parts, comprising:
a plated automotive part, comprising a base metal, a Ni layer on the base metal, and an outermost plating layer including an alloy, wherein the outermost plating layer has a Vickers hardness of 400 VHN or greater, and
a corresponding automotive part,
wherein the plated automotive part is configured to engage the corresponding automotive part,
wherein a surface of the corresponding automotive part that is configured to contact the plated automotive part has a hardness lower than the hardness of the outermost plating layer of the plated automotive part.

7. The system of claim 6, wherein the surface of the corresponding automotive part includes a coating containing molybdenum disulfide.

8. The system of claim 6, wherein the surface of the corresponding automotive part includes a coating containing fluorocarbon resin powder.

9. The system of claim 6, wherein the surface of the corresponding automotive part includes a manganese phosphate plating.

10. The system of claim 6, wherein the surface of the corresponding automotive part includes a zinc plating.

11. A seat belt tongue comprising an outermost plating layer including an alloy having a Vickers hardness of 400 VHN or greater.

12. The tongue of claim 11, wherein the alloy comprises Sn/Ni.

13. The tongue of claim 11, wherein a thickness of the outermost plating layer is less than about 20 μm.

14. The tongue of claim 11, wherein the outermost plating layer overlies at least one Ni layer.

15. The tongue of claim 14, wherein a combined thickness of the outermost plating layer and the at least one Ni layer is less than about 100 μm.

16. A seat belt system, comprising:
a seat belt buckle, comprising a base and a latch, and
a tongue, comprising an outermost plating layer including an alloy having a Vickers hardness of 400 VHN or greater,
wherein the tongue is configured to engage the seat belt buckle, wherein a hardness of a surface of the base and a hardness of a surface of the latch are lower than the hardness of the outermost plating.

17. The seat belt system of claim 16, wherein the surfaces of the base and the latch include a coating containing molybdenum disulfide.

18. The seat belt system of claim 16, wherein the surfaces of the base and the latch include a coating containing fluorocarbon resin powder.

19. The seat belt system of claim 16, wherein the surfaces of the base and the latch include a manganese phosphate plating.

20. The seat belt system of claim 16, wherein the surfaces of the base and the latch include a zinc plating.

* * * * *